US006110132A

United States Patent [19]

Kurpieski

[11] Patent Number: 6,110,132

[45] Date of Patent: Aug. 29, 2000

[54] BACK SCRATCHER

[76] Inventor: Edward J. Kurpieski, 657 Penny Ct., Carol Stream, Ill. 60188

[21] Appl. No.: 09/350,057

[22] Filed: Jul. 8, 1999

[51] Int. Cl.[7] ..... A61H 19/00

[52] U.S. Cl. ..... 601/136; 128/65; 18/160; 4/606

[58] Field of Search ..... 601/84, 136; 128/65; 18/160; 4/606

[56] References Cited

U.S. PATENT DOCUMENTS 3,359,588 12/1967 Kobler .
5,095,892 3/1992 Tsumura .
5,349,715 9/1994 Lewis, Jr. .
5,630,789 5/1997 Schock et al. .

*Primary Examiner*—Michael A. Brown
*Assistant Examiner*—Lalita Hamilton
*Attorney, Agent, or Firm*—Hill & Simpson

[57] ABSTRACT

A base having a top, a bottom, a center line extending from the top to the bottom, the base forming about a 90° angle about the center line and adapted to be removably mounted on a corner of a wall. A bristle carrier having two flanges and a cylindrical portion there between, each of the two flanges being mounted on the base so that the bristle carrier extends along the length of the base and is centered about the center line, the cylindrical portion having a surface area and a number of bristle receptors. Numerous bristles, each of the bristles having first and second ends, the first end of each of the bristles being positioned within a respective one of the bristle receptors, the second end of each of the bristles extending from the surface area.

25 Claims, 2 Drawing Sheets

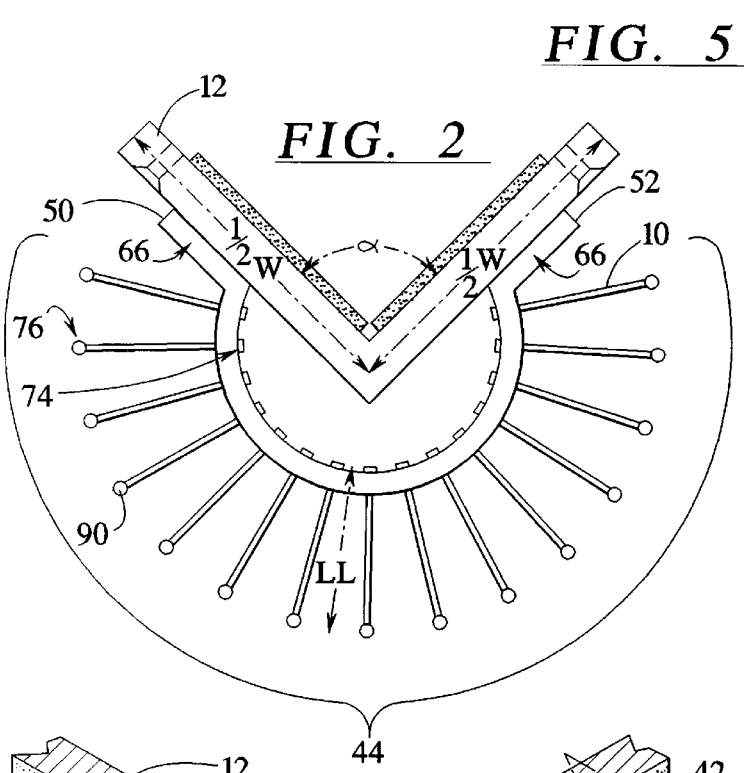
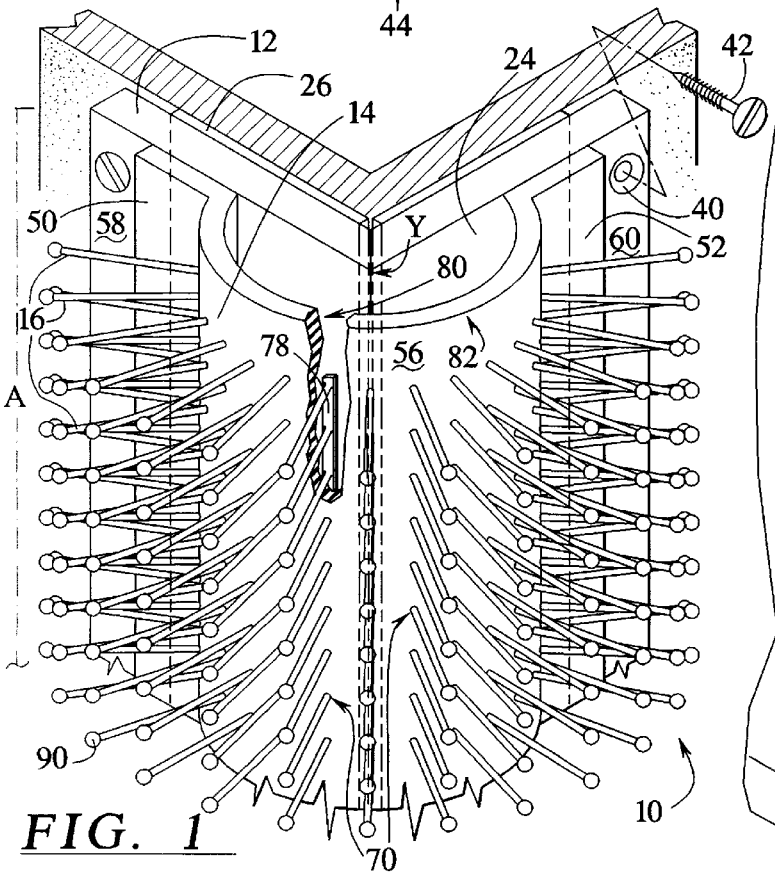
FIG. 1
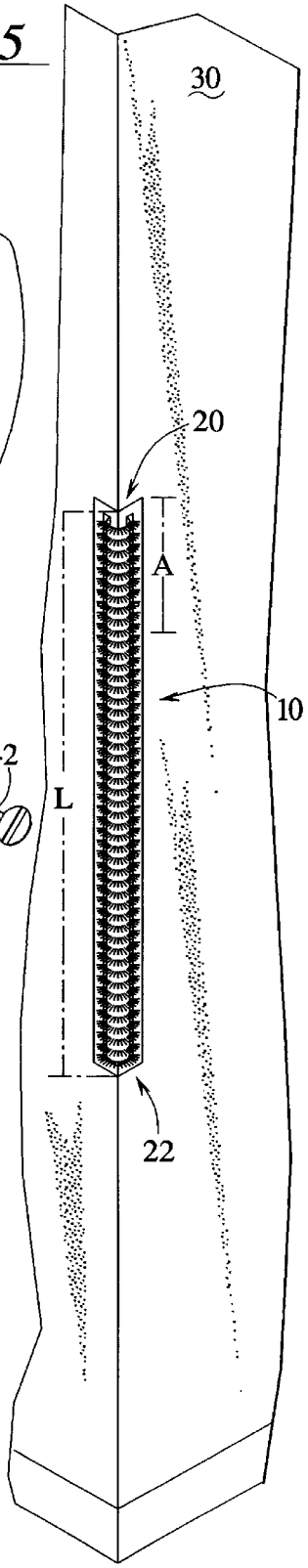

BACK SCRATCHER

BACKGROUND OF THE INVENTION

The present invention relates generally to a device for scratching a back of a human being. Specifically, the present invention relates to a back scratching device that can be mounted to a corner of a wall or door frame.

The back of the torso of a human being has always been a difficult area for a person to scratch one's self. This problem is especially evident for persons having a limited range of motion with the use of their arms and/or hands.

Various devices are known for scratching the back of a human being. Typically, such devices require the person to hold the device in his/her hand. The person must reach behind his/her head or behind and around his/her back with one's arm in order to scratch the surface area of the back. At times, a hand-held back scratcher can be awkward to maneuver around one's back. Also, a hand-held back scratchers come in varied lengths. Some back scratchers are small in length and width. As a result, a person has difficulty reaching certain areas of one's back. Moreover, the hand-held devices are burdensome, if not impossible, for use by a person that is handicapped or has a limited range of motion with the use of his/her extremities, e.g. arms and/or hands.

It is desirable to provide a mountable device for scratching the back side of a human being. Further, it is desirable to provide a device for scratching the back of a human being that is durable yet flexible.

SUMMARY OF THE INVENTION

The present invention provides a device for scratching the surface area of a back of human beings.

To this end, in an embodiment of the present invention, a back scratcher device includes a base having a front side, a back side, and a longitudinal center line, the base forms an angle about the center line so that the back side forms an interior angle capable of being removably mounted to a corner of a wall, a bristle carrier on the front side of the base, the bristle carrier having a numerous openings for receiving bristles, and bristles, each of the bristles having a first end secured within a respective one of the openings and a second end projecting from the bristle carrier.

In an embodiment, the base has an interior angle of about 90°.

In an embodiment, the bristle carrier includes two flanges and a cylindrical portion between the two flanges, each of the two flanges is mounted on the base and the cylindrical portion is adapted to receive the bristles.

In an embodiment, the back scratcher device further includes a bristle base adapted to receive the first end of a predetermined number of the bristles, the bristle base being positioned underneath the cylindrical portion.

In an embodiment, the cylindrical portion of the bristle carrier further includes an interior surface and each of the openings has dimensions, and the first end of each of the bristles includes a stopper that is larger in dimensions than the dimensions of the respective opening and the stopper is positioned along the interior surface.

In an embodiment, the bristles have varied resiliency.

In an embodiment, the bristles project generally radially from the bristle carrier.

In an embodiment, each of the bristles has a length and the bristles vary in each respective length from the top to the bottom of the base.

In an embodiment, the back scratcher device further includes a backing member underneath the cylindrical portion of the bristle carrier.

In an embodiment, the second end of each of the bristles includes a ball-like tip.

In an embodiment, the base is mounted to the corner of a wall or door frame via bolt, screw, or nail.

In an embodiment, an adhesive material is applied to the back side of the base for mounting the device on the corner of the wall or door frame.

It is, therefore, an advantage of the present invention to provide a device for back scratching that is removably mountable to a corner section of a wall or door frame.

Another advantage of the present invention is to provide a device for back scratching that allows a person to scratch his/her back without having to use one's hands or arms.

Another advantage of the present invention is to provide a device for back scratching that can be used by persons having a limited range of motion in their arms and/or hands.

It is a further advantage of the present invention to provide a device for back scratching that incorporates bristles having varied stiffness and resiliency.

These and other advantages and/or features of the present invention are described below in the following detailed description of the presently preferred embodiments with reference to the accompanying drawings.

DETAILED DESCRIPTION OF THE DRAWINGS

FIG. 1 is a close-up perspective view of section A of a device for scratching the back side of a human being incorporating principles of the invention.

FIG. 2 is a cross-sectional top view of the device of FIG. 1.

FIG. 5 is a perspective view of the device mounted to a corner of a wall.

DETAILED DESCRIPTION OF THE PRESENTLY PREFERRED EMBODIMENTS

Figure 4:
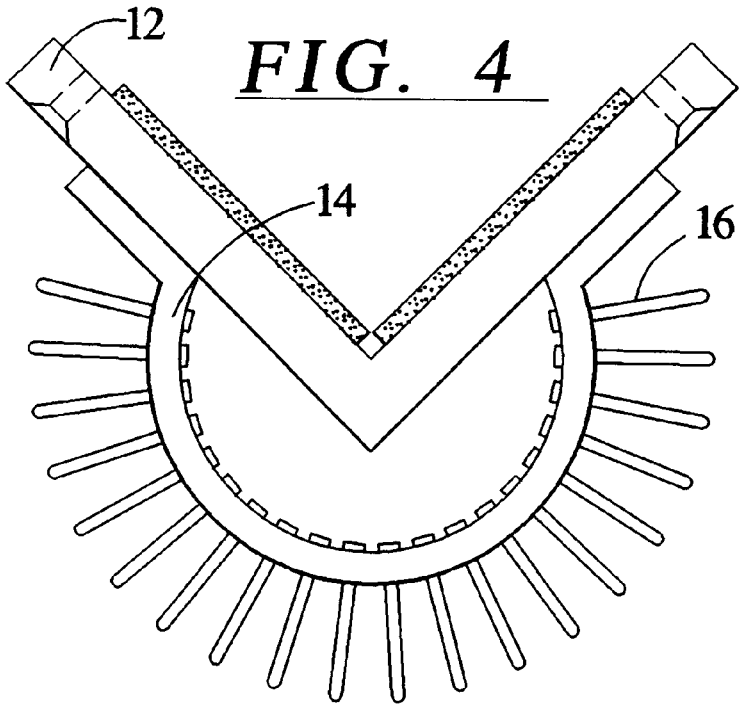
FIG. 4 is a cross-sectional top view of an alternative embodiment of the device of FIG. 1.

Generally, FIGS. 1 through 5 illustrate a device for scratching a back of a human being incorporating principles of the invention.

Specifically, FIG. 1 shows a section A of a back scratcher device 10 incorporating the invention. The back scratcher device 10 includes a base 12, a bristle carrier 14 and a number of bristles 16. The base 12 has a top 20, a bottom 22, a front side 24 and a back side 26.

Generally, the base 12 is rectangular in shape. The base 12 has a center line Y that extends longitudinally from the top 20 to the bottom 22 of the base 12. The base 12 is angled so that the center line Y acts as an axis. To this extent, the back side 26 of the base 12 forms an interior angle $\alpha$ that is approximately 90° so that the base 12 is adaptable to be mounted on a wall or a door frame 30 (see FIGS. 2 and 5). The base 12 may be mounted permanently or temporarily to the wall or door frame 30. In FIG. 1, the base 12 includes mounting holes 40 so that the device 10 may be removably mounted via a nail, screw or bolt 42. However, the base 12 can also include an adhesive material applied to the back side 26 so that the device 10 may be adhesively mounted to the wall or door frame. It is also possible that the base 12 may be mounted via hooks secured into a wall or door frame.

The base 12 is made of a plastic, metal or semi-flexible rubber material. The material of the base 12 should be durable and capable of withstanding pressure from the movement of a person's back along a surface 44 of the device, whether the movement is in an up-and-down motion or in a side-to-side motion. The base 12 has a length L that is approximately 12 inches to 48 inches from the top 20 of the base 12 to the bottom 22 of the base 12. The base 12 also has a width W of approximately 2 inches.

The bristle carrier 14 extends approximately the length L of the base 12 and is mounted onto the front side 24 of the base 12. The bristle carrier 14 is, generally, tubular in the shape. The bristle carrier 14 is sectioned so that two flanges 50, 52 extend from a cylindrical portion 56. The two flanges 50, 52 are mounted to the front side 24 of the base 12. Specifically, a first flange 50 is mounted to a first part 58 of the front side 24. A second flange 52 is mounted to a second part 60 of the top side 24. The cylindrical portion 56 extends along and is centered about the center line Y of the base 12. As an alternative, sections 64 of the first part 58 and the second part 60 may be modified so that the width of the base does not extend beyond the flanges 50, 52. Here, the mounting holes 40 would extend through a portion 66 of each of the flanges as well as the base.

The bristle carrier 14 is generally made from a flexible material such as rubber. In the present invention the cylindrical portion 56 includes a matrix of bristle receptors or openings 70 for receiving the bristles 16. Generally, the bristle carrier 14 is one continuous molded piece. However, the bristle carrier 14 may be divided into sections as will be described in detail with respect to FIGS. 2 through 4 below. It is also within the scope of the invention to provide the base and bristle carrier as one molded piece.

A series of bristles 16 are arranged within the bristle receptors 70 of the cylindrical portion 56. Specifically, the bristles 16 are arranged in rows and columns. The bristles 16 are made from a plastic material. Each of the bristles 16 projects from the cylindrical portion 56. The bristles 16 generally are cylindrical in shape and a have a first end 74 and a second end 76.

The first end 74 of each of the bristles 16 is secured within the respective bristle receptor 70 of the cylindrical portion 56. To this end, the bristles 16 may be secured within the cylindrical portion 56 via a common bristle base 78 (as shown in FIG. 1). In this embodiment, the common base 78 is mounted underneath the cylindrical portion 56 at an interior side 80 of the cylindrical portion 56. Generally, a number of common bases 78 will be provided. Each common base 78 holds a row or column of bristles 16. The common base 78 and the bristles 16 may be one molded piece. It is also possible to have the common base 78 separate from the bristles 16 so that each individual bristle is attached into the common base 78. However, this later scenario may be more labor intensive. Alternatively, a common base 78 may not be necessary if each of the bristles 16 includes a stopper (not shown) at the first end 74. The stopper has wider dimensions than the dimensions of the respective opening in the cylindrical portion 56 of the bristle carrier 14. As a result, each bristle 16 is individually secured within the bristle carrier 14.

The second end 76 of the bristles 16 projects in a generally radial direction from the cylindrical portion 56 and extends generally perpendicular to an outer surface 82 of the cylindrical portion 56. However, it is also within the scope of the invention to have bristles that extend in an obtuse or acute angle from the surface. The resultant arcuate surface area of the bristles provides a maximum scratching surface area. This is especially evident when the central part of a back of a human being is being scratched because the back naturally curves around the bristles as the person scratches his/her back along his/her backbone.

It is also within the scope of the invention to provide a device 10 that has bristles projecting directly from the base 12. Such a device would eliminate the bristle carrier 14 having the cylindrical portion 56.

In order to provide optimum scratching capability, the bristles 16 may vary in length from the top 20 to the bottom 22 of the device 10. A variance in length LL in the bristles 16 results in varied resiliency of the bristles 16 thus, increasing or decreasing the amount of pressure that is applied to the back of a human being when the invention is in its application.

For example, in FIG. 2 the bristles 16 are relatively long and include rounded ball-like tips 90. The rounded ball-like tips 90 are preferable for a milder scratching surface.

Figure 3:
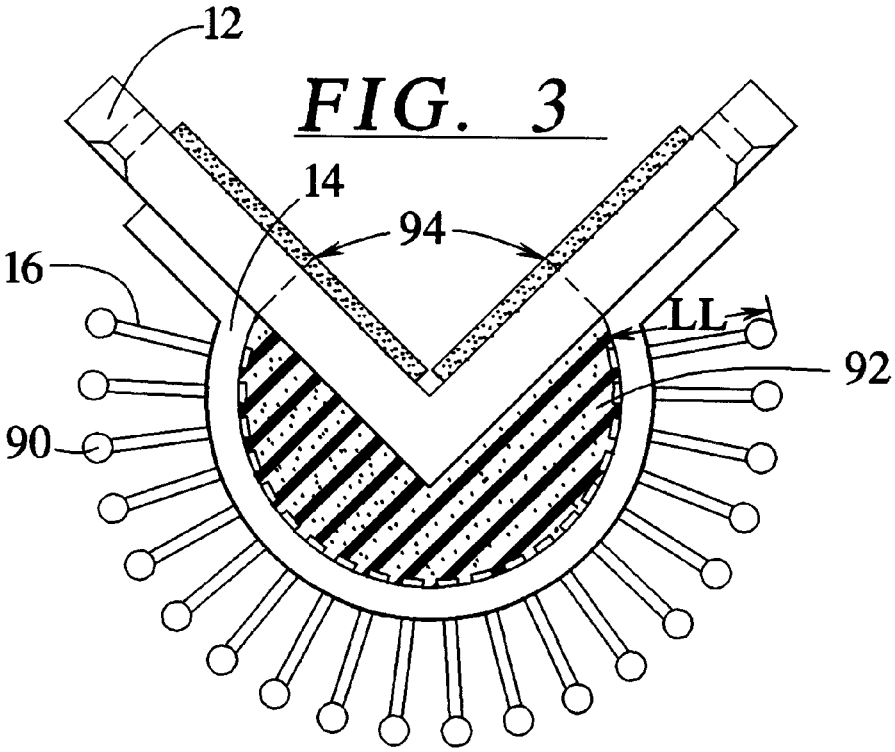
FIG. 3 is a cross-sectional top view of an alternative embodiment of the device of FIG. 1.

Alternatively, FIG. 3 shows bristles 16 that are shorter in length LL in comparison to FIG. 2. The shortened bristles 16 provide a less arcuate scratching surface area. The bristles 16 in FIG. 3 are also closer in proximity to each other. Even though the bristles 16 in FIG. 3 also have ball-like tips 90, the bristles 16 have an increase in resiliency due to shortened length. As a result, the bristles 16 of FIG. 3 provide a stiffer scratching surface.

FIG. 3 also illustrates an embodiment that includes filling the cylindrical portion 56 with a backing member 92 such as a foam or rubber material. In this embodiment, the backing member 92 can also provide support to the bristles so that the bristles can not be pushed through the bristle carrier. Moreover, it is also possible to eliminate an internal corner portion 94 of the base, if desired for manufacturing purposes, because the backing member 92 will abut the corner of the wall or door frame 30 when mounted.

Another example is shown in FIG. 4. In FIG. 4, the bristles 16 are short like the bristles in FIG. 3. However, the bristles 16 do not have ball-like tips at the second end 76. As such, the bristles in FIG. 4 provide an even stiffer scratching surface.

FIG. 5 shows the back scratching device 10 mounted to a corner of a wall or doorframe 30. As stated above, the cylindrical portion 56 may be molded as one piece or may be divided into sections that are capable of the being removably mounted to the base. An advantage of the removably mountable sectional tube is that a user can adjust the corresponding stiffness of the bristle with the preferable location along the base for maximizing the benefits of the device. Also, the person may adjust the length of the device 10 depending on the area in which the device is to be mounted. However, it is also within the scope of the invention to provide one molded back scratching device 10 that has bristles of varied resiliency along the cylindrical portion 56.

It is seen that this invention provides a device for back scratching. It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A back scratcher device for mounting to a corner of a wall, comprising:

a base having a front side and a wall mounting back side, the wall mounting back side configured to form an interior angle mateable to the corner of the wall and capable of being mounted to the corner of the wall;

a bristle carrier on the front side of the base, the bristle carrier having a plurality of openings for receiving bristles;

a plurality of bristles, each of the plurality of bristles having a first end secured within a respective one of the plurality of openings and a second end projecting from the bristle carrier away from the wall; and a wall mount on the base.

2. The back scratcher device in claim 1, wherein the interior angle is about 90°.

3. The back scratcher device in claim 1, wherein the bristle carrier further comprises two flanges and a cylindrical portion between the two flanges, each of the two flanges mounted on the base and the cylindrical portion adapted to receive the plurality of bristles.

4. The back scratcher device in claim 3, further comprising:

a bristle base adapted to receive the first end of a predetermined number of the bristles, the bristle base being positioned underneath the cylindrical portion.

5. The back scratcher device in claim 3, wherein the cylindrical portion further includes an interior surface, and the first end of each of the plurality of bristles includes a stopper that is larger in dimensions than the respective dimensions of one of the plurality of openings, the stopper being positioned along the interior surface.

6. The back scratcher device in claim 3, further comprising:

a backing member underneath the cylindrical portion of the bristle carrier.

7. The back scratcher device in claim 1 wherein the plurality of bristles project generally radially from the bristle carrier.

8. The back scratcher device in claim 1 wherein the plurality of bristles have varied resiliency.

9. The back scratcher device in claim 1, wherein each of the plurality of bristles has a length and the plurality of bristles vary in each respective length from the top to the bottom of the base.

10. The back scratcher device in claim 1, wherein the second end of each of the plurality of bristles includes a ball-like tip.

11. The back scratcher device in claim 1, wherein the wall mount mount is configured to receive one of a bolt, screw and nail.

12. The back scratcher device in claim 1, wherein the wall mount is an adhesive material applied to the wall mounting back side of the base.

13. The back scratcher device in claim 1, wherein the wall mount mounts the base to the corner of the wall via at least one hook.

14. The back scratcher device in clam 1, wherein the base includes a first member and a second member, the first and second members being jointed together.

15. The back scratcher device in claim 14, wherein the first and second members are jointed together via a hinge.

16. A back scratcher device, comprising:

a substantially rigid base having a top and a bottom, the base forming about a 90° angle and adapted to be mounted on a corner of a wall;

a bristle carrier having two flanges and a cylindrical portion there between, each of the two flanges being mounted on the base so that the bristle carrier extends along a length of the base, the cylindrical portion having a surface area and a plurality of bristle receptors;

a plurality of bristles, each of the plurality of bristles having first and second ends, the first end of each of the plurality of bristles being positioned the plurality of bristle receptors, the second end of each of the plurality of bristles extending generally perpendicular from the surface area; and a wall mount for mounting the base to the corner of the wall.

17. The back scratcher device in claim 16, wherein the cylindrical portion includes an interior side, the device further comprising:

a bristle base adapted to receive the first end of a predetermined number of the plurality of bristles, the bristle base being positioned at the interior side of the cylindrical portion.

18. The back scratcher device in claim 16, wherein the wall mount mounts the base to the corner of a wall via one of a bolt, screw and nail.

19. The back scratcher device in claim 16, wherein the wall mount is an adhesive applied to the base.

20. A back scratcher device, comprising:

a bristle carrier having a cylindrical portion, the cylindrical section having two ends and a flange extending from each end, the cylindrical portion further having an interior and an exterior and a plurality of bristle receptors extending from the interior to the exterior;

a plurality of bristles, each of the plurality of bristles extending from a common bristle base, the common bristle base being positioned at the interior of the cylindrical portion and each of the plurality of bristles projecting through the bristle receptors and extending from the exterior of the cylindrical portion;

a base having a top, a bottom, a center line extending from the top to the bottom, the base forming about a 90° fixed angle about the center line and adapted to be removably mounted on a corner of a wall, each of the two flanges being mounted on the base so that the bristle carrier extends along the length of the base and is centered about the center line; and means for mounting the base to the corner of the wall.

21. The back scratcher device in claim 20 wherein the plurality of bristles extends generally radially from the exterior.

22. The back scratcher device in claim 20, wherein the means for mounting the base to the corner of the wall is one of a bolt, screw and nail.

23. The back scratcher device in claim 20, wherein the means for mounting the base to the corner of the wall is an adhesive.

24. A back scratcher device comprising:

an elongated member having first and second legs jointed together to project from one another at a substantially right angle whereby the member can be attached to an outside corner of a wall with each leg member extending away from the apex of the corner;

a plurality of projecting bristles carried by the first and second legs projecting outwardly therefrom and wherein the first and second legs have a length providing a vertical span of between about 12 inches and 38 inches and wherein the bristles project from the first and second legs for substantially the entire vertical length; and a wall mount for mounting the base to the corner of the wall.

25. The back scratcher device in claim 24, wherein the first and second legs are jointed together via a hinge.

* * * * *